US005356040A

United States Patent [19]

Reggiani

[11] Patent Number: 5,356,040

[45] Date of Patent: Oct. 18, 1994

[54] CONTAINER PARTICULARY FOR MULTICOMPONENT PRODUCTS

[75] Inventor: Fulvio Reggiani, Tradate, Italy

[73] Assignee: Maplast S.r.l., Tradate, Italy

[21] Appl. No.: 32,034

[22] Filed: Mar. 16, 1993

[30] Foreign Application Priority Data

Mar. 31, 1992 [IT] Italy ..... 000309/92[U]

[51] Int. Cl.[5] ..... B65D 21/02

[52] U.S. Cl. ..... 222/129; 220/23.4; 220/737; 220/238.3; 215/6

[58] Field of Search ..... 222/135, 137, 94, 321, 222/402.1; 215/1 C, 6, 10; 220/23.2, 23.4, 23.83, 500, 507, 481, 480, 737

[56] References Cited

U.S. PATENT DOCUMENTS

| | | | |
|---|---|---|---|
| 3,994,408 | 11/1976 | Belitzky | 215/10 |
| 4,165,812 | 8/1979 | Jennison | 215/10 |
| 4,189,057 | 2/1980 | Morille | 215/10 |
| 4,260,077 | 4/1981 | Schroeder | 220/23.4 |
| 4,592,478 | 6/1986 | Laconis | 215/10 |
| 4,817,809 | 4/1989 | Rozmestor | 220/23.4 |
| 4,826,048 | 5/1989 | Skorka et al. | 222/321 |
| 4,899,913 | 2/1990 | Ruscitti et al. | 222/321 |
| 4,958,750 | 9/1990 | Palmert et al. | 222/135 |
| 5,139,299 | 8/1992 | Smith | 220/23.4 |
| 5,170,907 | 12/1992 | Sakai | 220/481 |

FOREIGN PATENT DOCUMENTS

| | | | |
|---|---|---|---|
| 1480678 | 4/1967 | France | 215/10 |
| 2647093 | 11/1990 | France . | |

*Primary Examiner*—S. Castellano

*Attorney, Agent, or Firm*—Guido Modiano; Albert Josif; Daniel O'Byrne

[57] ABSTRACT

Container particularly for multicomponent products, including a first tank and a second tank each having, on a respective outer wall, a median portion which rises from the wall itself. The median portion is provided with seats for accommodating engagement pins which rise from a coupling partition provided with a frame shaped complementarily with respect to each outer wall of the tanks.

9 Claims, 2 Drawing Sheets

CONTAINER PARTICULARY FOR MULTICOMPONENT PRODUCTS

BACKGROUND OF THE INVENTION

The present invention relates to a container particularly for multicomponent products.

Particular products which comprise at least two active components which can be used for their aesthetic effects when mixed in appropriate doses are used in cosmetology. The problem which arises is indeed linked to the active components, which in some cases lose their effectiveness if they are placed in contact with other active components or are severely limited in terms of the persistence of their activity.

Furthermore, in many other fields of application there is the need to keep chemically incompatible liquids or emulsions separate until they are dispensed.

In order to solve this problem, multicomponent containers have been used; said containers have at least one pair of containers which allow to mix the components of the cosmetic product just before or during their application.

These containers usually comprise a pair of containers, in the case of two components, which are kept close together by means of an external retention cup within which they are inserted with one of their ends, whereas their dispenser is a dispensing actuation closure which allows to mix the active components before or during their dispensing.

However, this solution leads to considerable problems, since the connection of the two containers is not stable. It should be furthermore stressed that the outer cup, which may also be metallic, reduces the printable surface of the containers, to the detriment of the information which must be printed thereon according to the applicable statutory provisions.

SUMMARY OF THE INVENTION

An aim of the present invention is to eliminate or substantially reduce the problems described above by providing a container particularly for multicomponent products which eliminates the use of external cups for the containment and mutual coupling of the containers.

Another object of the present invention is to provide a container which allows to obtain a stable coupling between the two containers of the individual products.

Not least object of the present invention is to provide a container which is highly reliable, relatively easy to manufacture and at competitive costs.

This aim, the objects mentioned and others which will become apparent hereinafter are achieved by a container particularly for multicomponent products according to the invention, characterized in that it comprises a first tank and a second tank each having, on a respective outer wall, a median portion which rises from said wall, said median portion having seats for accommodating engagement means which rise from a coupling partition, said partition having a frame which is shaped complementarily with respect to each outer wall of said tanks.

BRIEF DESCRIPTION OF THE DRAWINGS

Further characteristics and advantages of the present invention will become apparent from the following description of a preferred embodiment of a container particularly for multicomponent products, illustrated only by way of non-limitative example in the accompanying drawings, wherein.

DESCRIPTION OF THE PREFERRED EMBODIMENTS

Figures 1, 2:
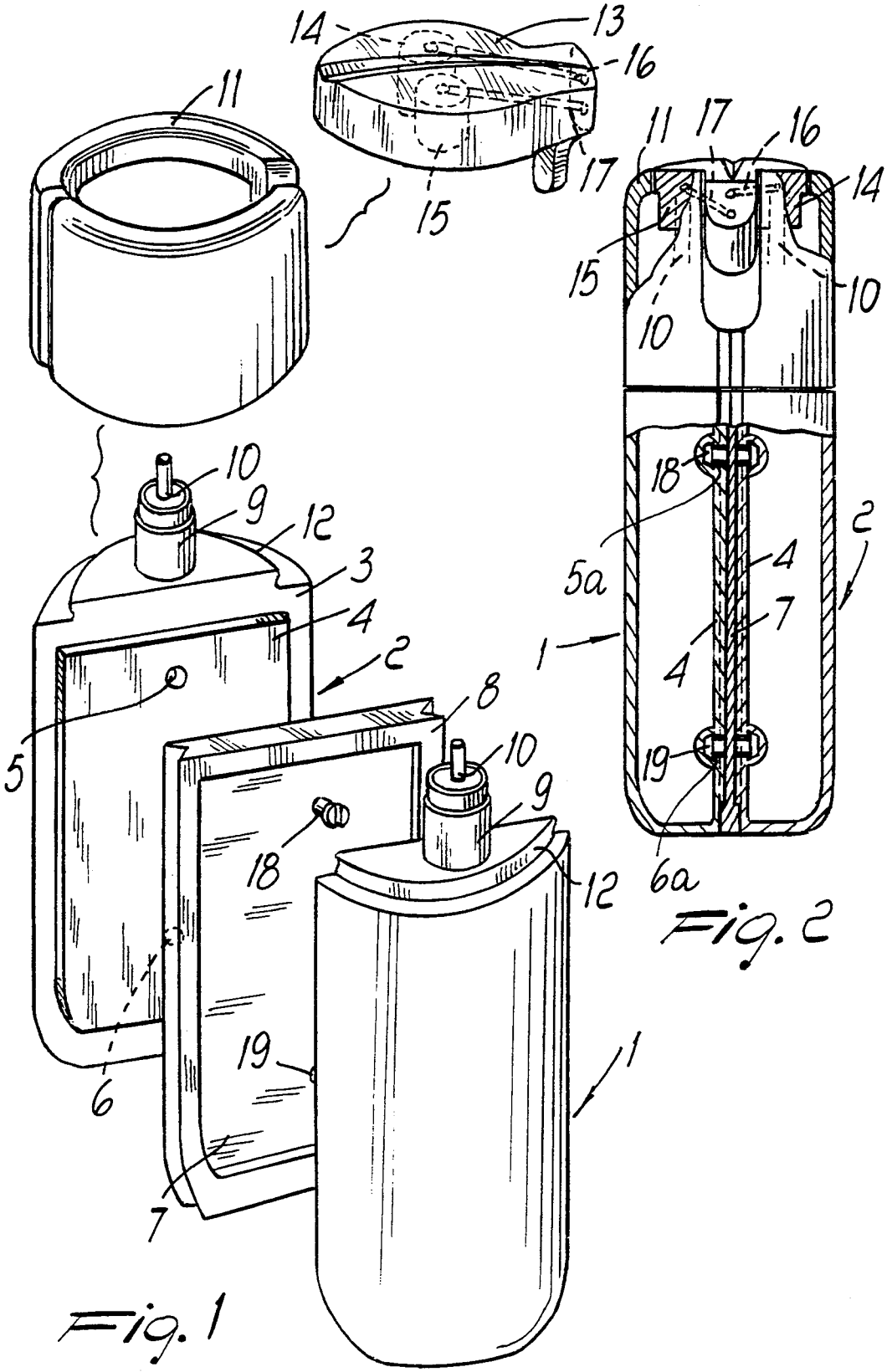
FIG. 1 is an exploded perspective view of a container according to the invention.
FIG. 2 is a partially sectional front elevation view of the container.
Figure 3:
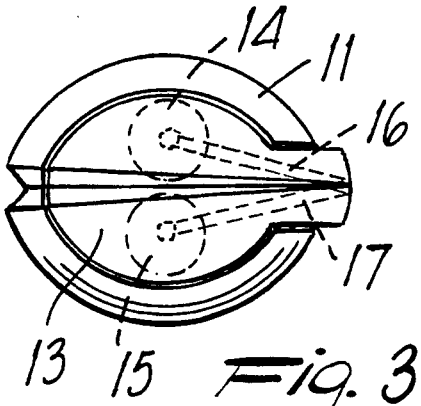
FIG. 3 is a plan view of a dispenser closure.
Figure 4:
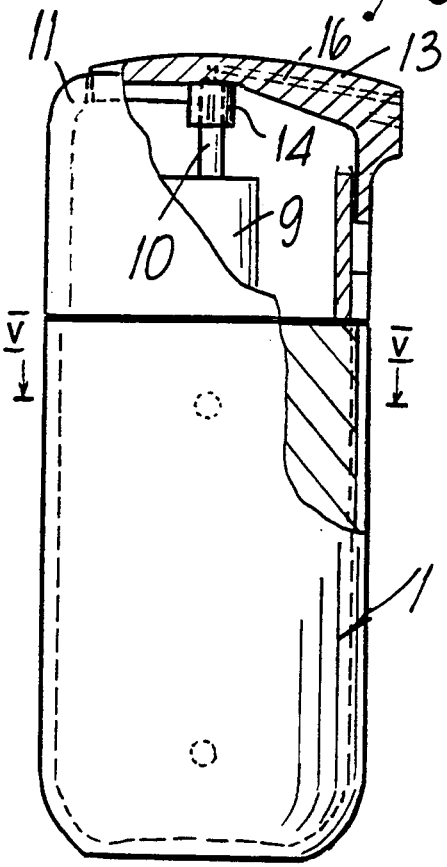
FIG. 4 is a partially sectional lateral elevation view of the container.
Figure 5:
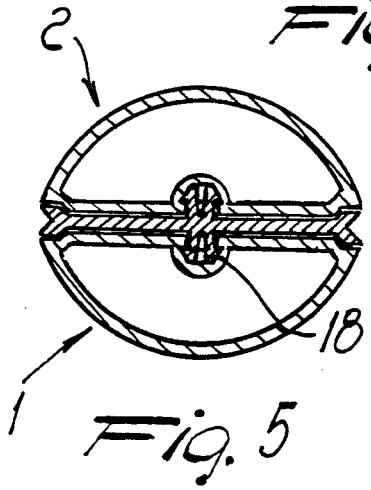
FIG. 5 is a sectional plan view, taken along the plane V—V of FIG. 4.
Figure 6:
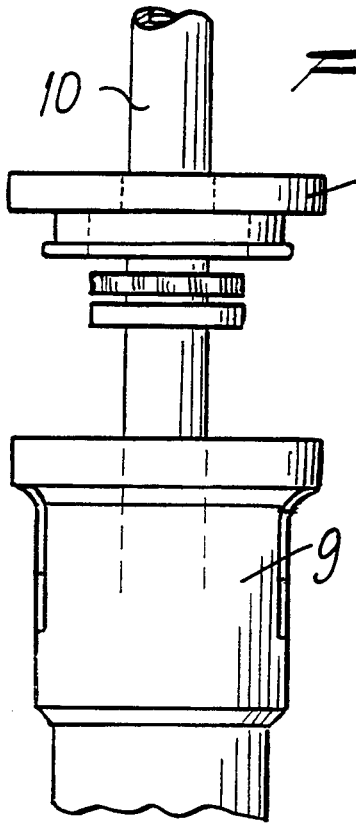
FIG. 6 is an exploded front elevation view of the neck of a tank with the respective dispenser valve.
Figure 7:
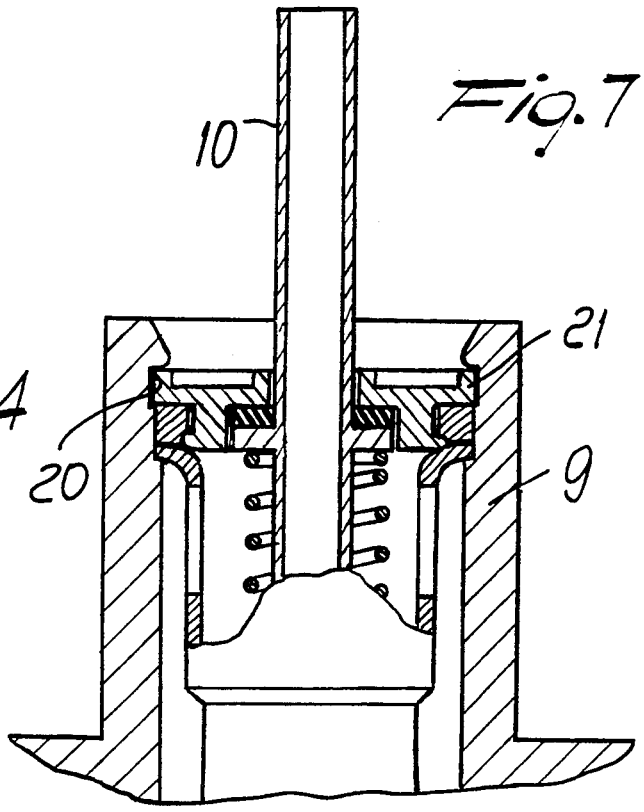
FIG. 7 is a sectional front elevation view of the neck with the valve installed.

With reference to FIGS. 1 to 5, a container particularly for multicomponent products comprises a first tank 1 and a second tank 2 which have, on a respective outer wall 3, a median portion 4 which rises or protrudes from said wall 3.

The median portion 4 is provided with accommodation seats 5 and 6 for engagement means which rise from a coupling partition 7 which has, at each opposite side thereof, a frame 8 shaped complementarily with respect to each median portion 4 of the tanks 1 and 2.

Each tank 1 and 2 is provided with a respective neck 9 in which, as explained more clearly hereinafter, a respective dispenser valve 10 is fixed.

In order to improve the coupling between the tanks, there is an upper collar 11 provided with an internal perimetric annular groove, not shown, which couples to a complementarily shaped ridge 12 defined on the upper portion of the tanks 1 and 2 which is provided with the neck 9.

In order to perform correct dispensing, there is a dispenser closure 13 provided with a pair of actuation stoppers 14 and 15 which engage on the valves 10; each actuation stopper 14 and 15 is provided with a respective dispensing duct 16 and 17 in order to simultaneously dispense the two chemically incompatible emulsions or active components or liquids contained in the two different tanks 1 and 2.

Each accommodation seat 5 and 6 has, in the median portion 4, a blind cavity, designated by the same reference numeral, which has a respective undercut 5*a* and 6*a* against which the engagement means engage; each engagement means comprises a pin 18 and 19 which protrudes from the partition 7. Each pin 18 or 19 has, FIG. 5, its head split transversely so as to engage with the respective undercuts 5*a* and 6*a*.

Furthermore, advantageously, the metallic strip which usually fixes the valve to the neck of the respective tank is eliminated by providing on the neck 9, or rather on its internal surface, an annular recess 20 which defines an undercut in which a perimetric edge 21 of the dispenser valve 10, which is preferably of the recirculation type, engages.

Assembly of the container according to the invention is as follows: the median portions 4 are inserted in the frame 8, coupling the cavities 5 and 6 to the respective pins 18 and 19. Then the tanks 1 and 2 are mutually coupled by pressing, and then the collar 11 is mounted, followed finally by the closure 13, which completes the package of the cosmetic product.

Conveniently, the ducts 16 and 17 can lead out at a single point, or in two separate but adjacent points, FIG. 2, or can be joined, from a certain portion onward, in a single duct, according to the type of mixing to be imposed between the active components of the cosmetic substance contained in the tanks 1 and 2.

Practical tests have shown that the present invention achieves the intended aim and objects, eliminating both troublesome external retention cups and the use of adhesives during assembly, and advantageously eliminating metallic strips for fixing the valves to the necks of the respective tanks, which constitute their highest cost.

In practice, the materials employed, as well as the dimensions, may be any according to the requirements.

I claim:

1. Container structure for dispensing multicomponent products comprising;

a first tank and a second tank each having a dispensing valve, a side wall, a median portion protruding from said side wall, and a shaped ridge located adjacent said median portion;

accommodation seats provided on said median portion of said first tank and on said median portion of said second tank;

a coupling partition having engagement pins and a frame, said frame accommodating said median portion of said first tank and said median portion of said second tank, said engagement pins protruding from opposite sides of said coupling partition and engaging said accommodation seats for interconnecting said first tank, said coupling partition and said second tank;

a dispenser closure having at least two actuation stoppers, said actuation stoppers engaging said dispensing valve on said first tank and said second tank and each having a dispensing duct, for simultaneously dispensing contents of said first tank and said second tank;

a collar engaging said shaped ridge formed on said first tank and said second tank and at least partially embracing said first tank, said coupling partition, said second tank, and said dispenser closure.

2. Container structure according to claim 1, wherein said accommodation seats each comprise a blind cavity, and undercuts formed within said blind cavity, and wherein said partition engagement means comprise pins having split heads, said pins protruding from said coupling partition, said split heads engaging said undercuts.

3. Container structure according to claim 1, wherein said dispensing duct of each said actuation stopper exit said dispenser closure at separate adjacent points.

4. Container structure for dispensing multicomponent products comprising;

a first tank and a second tank each having a dispensing valve, a median portion, and coupling means located adjacent said median portion of said first tank and said median portion of said second tank;

tank connection means provided on said median portion of said first tank and said median portion of said second tank;

a coupling partition having engagement means formed thereon, said partition engagement means being coupled to said tank connection means for interconnecting said first tank, said coupling partition and said second tank;

a dispenser closure connected to each said dispensing valve of said first tank and said second tank, and;

a collar having collar engagement means, said collar engagement means engaging said coupling means formed on said first tank and said second tank and at least partially embracing said first tank, said coupling partition, said second tank, and said dispenser closure, wherein said tank connection means comprise accommodation seats provided on said median portion of said first tank and on said median portion of said second tank, and wherein said partition engagement means protrude from said coupling partition and are accommodated within said accommodation seats, wherein said accommodation seats each comprise a blind cavity, and undercuts formed within said blind cavity, and wherein said partition engagement means comprise pins having split heads, and pins protruding from said coupling partition, said split heads engaging said undercuts.

5. Container structure according to claim 4, wherein said dispenser closure comprises at least two actuation stoppers engaging each said dispensing valve on said first tank and said second tank, each of said actuation stoppers having a dispensing duct, for simultaneously dispensing contents of said first tank and said second tank.

6. Container structure according to claim 5, wherein said dispensing duct of each said actuation stopper exit said dispenser closure at separate adjacent points.

7. Container structure according to claim 4, wherein said first tank and said second tank each have a side wall, each said median portion protruding from a respective side wall of said first tank and said second tank, and wherein said coupling partition has a frame, said frame accommodating each said median portion of said first tank and said second tank.

8. Container structure for dispensing multicomponent products comprising;

a first tank and a second tank each having a dispensing valve;

a coupling partition located between and interconnecting said first tank and said second tank;

a dispenser closure comprising at least two actuation stoppers engaging said dispensing valve on said first tank and said second tank, each of said actuation stoppers having formed therein a dispensing duct, for simultaneously dispensing contents of said first tank and said second tank, and;

a collar engaging said first tank and said second tank and at least partially embracing said first tank, said coupling partition, said second tank, and said dispenser closure, wherein said first tank and said second tank each have a median portion, coupling means located adjacent said median portion of said first tank and said median portion of said second tank, and tank connection means provided on said median portion of said first tank and said median portion of said second tank, said container further comprising;

partition engagement means formed on said coupling partition and coupled to said tank connection means for interconnecting said first tank, said coupling partition and said second tank, and;

collar engagement means formed on said collar and engaging said coupling means formed on said first tank and said second tank, wherein said tank connection means comprise at least two accommodation seats provided on each said median portion of said first tank and on said median portion of said second tank, and wherein said partition engagement means protrude from said coupling partition and are accommodated within said accommodation seats, wherein said at least two accommodation seats each comprise a blind cavity, and undercuts formed within said blind cavity, and wherein said partition engagement means comprise at least two pins protruding from each side of said coupling partition, said pins having split heads, said split heads engaging said undercuts.

9. Container structure according to claim 8, wherein said first tank and said second tank each have a side wall, and a median portion protruding from said side wall, and;

wherein said coupling partition has a frame, said frame accommodating each said median portion of said first tank and said second tank.

* * * * *